US006179456B1

(12) United States Patent
Nakamura et al.

(10) Patent No.: US 6,179,456 B1
(45) Date of Patent: Jan. 30, 2001

(54) VEHICLE LAMP WITH PROTECTIVE FILM AND METHOD FOR MAKING SAME

(75) Inventors: Koichi Nakamura; Hidetaka Anma; Shinji Aikawa; Mariko Warashina, all of Shizuoka (JP)

(73) Assignee: Koito Manufacturing Co., Ltd., Tokyo (JP)

( * ) Notice: Under 35 U.S.C. 154(b), the term of this patent shall be extended for 0 days.

(21) Appl. No.: 09/220,349

(22) Filed: Dec. 24, 1998

(30) Foreign Application Priority Data

Dec. 24, 1997 (JP) ..... 9-354981

(51) Int. Cl.[7] ..... F21V 9/06
(52) U.S. Cl. ..... 362/510; 362/293
(58) Field of Search ..... 362/293, 264, 362/510; 313/112, 635; 428/412

(56) References Cited

U.S. PATENT DOCUMENTS 4,243,719 * 1/1981 Holmes ..... 428/412
5,132,881 7/1992 Wakimizu et al. ..... 362/61
5,134,223 * 7/1992 Langer et al. ..... 528/272
5,180,218 1/1993 Ohshio ..... 362/61
5,180,760 1/1993 Oshibe et al. ..... 523/169
5,243,501 9/1993 Makita et al. ..... 362/61

FOREIGN PATENT DOCUMENTS 2-255854 10/1990 (JP) .

* cited by examiner

*Primary Examiner*—Y. Quach
(74) *Attorney, Agent, or Firm*—Morgan, Lewis & Bockius LLP

(57) ABSTRACT

A lamp for use in adverse conditions such as in a headlamp for a vehicle includes a coating for preventing mist, condensation or other haze from forming on a front lens and/or for preventing discoloration of the front lens caused by UV light emitted from a light source. The lamp has a discharge-lamp bulb serving as the light source, the discharge-lamp bulb being disposed in the lamp chamber. The lamp chamber can be defined by the lamp body and the front lens. The coating can comprise an anti-haze/UV film that is prepared by mixing a UV absorbing material with an anti-haze material.

20 Claims, 4 Drawing Sheets

| | wt. % | thickness ($\mu$ m) |
|---|---|---|
| A | 0 | 3.7 |
| B | 4 | 3.5 |
| C | 6 | 4.8 |
| D | 8 | 3.4 |
| E | 10 | 3.0 |

| item \ wt. (%) | 0 | 4 | 6 | 8 | 10 | 11 | 15 |
|---|---|---|---|---|---|---|---|
| Exhalation anti-haze test | ○ | ○ | ○ | ○ | ○ | ○ | △ slightly dim |
| steam test (80℃) | ○ | ○ | ○ | ○ | ○ | ○ | △ slightly dim |
| Exhalation anti-haze test after hot water immersion at 40℃ (for 240 hours) | ○ | ○ | ○ | ○ | ○ | △ slightly dim | × dim |

ANTI-HAZE PERFORMANCE ACCORDING TO DIFFERENT WEIGHTS

○ GOOD (NO ERROR)

△ FAIR (SLIGHTLY INFERIOR)

× FAIL (INFERIOR)

Fig.3

| thickness (μm) / capability | 0.5 | 1 | 5 | 8 | 10 | 11 |
|---|---|---|---|---|---|---|
| asppearance (initial) | × getting rough | △ | ○ | ○ | △ small blooming | × large blooming |
| adhesiveness | ○ | ○ | ○ | ○ | ○ | × |
| anti-haze (durability) | △ | ○ | ○ | ○ | ○ | △ |
| result | × | △ | ○ | ○ | △ | × |

PARFORMANCE ACCORDING TO DIFFERENT THICKNESSES

○ GOOD (NO ERROR)

△ FAIR (SLIGHTLY INFERIOR)

× FAIL (INFERIOR)

Fig.4

VEHICLE LAMP WITH PROTECTIVE FILM AND METHOD FOR MAKING SAME

This application claims the benefit of Japanese patent application No. Hei 9-354981, filed on Dec. 24, 1997 which is hereby incorporated by reference.

BACKGROUND OF THE INVENTION

1. Field of Invention

The invention relates to a lamp for use in an outdoor environment. In particular, the invention relates to a headlamp for a vehicle that includes a protective film located on a front lens of the vehicle headlamp and a method for making the vehicle headlamp. The film prevents mist, condensation or other haze from forming on the inside of the lamp chamber while also preventing discoloration of the front lens of the headlamp caused by UV light emitted from a light source located in the headlamp.

2. Discussion of Related Art

Conventional vehicle headlamps often include a lamp body that cooperates with a front lens formed of resin to form a lamp chamber. A discharge lamp bulb located within the lamp chamber acts as a light source. Typical discharge lamp bulbs for vehicle headlamps emit light containing UV light of great energy. This UV light tends to discolor the front lens and, after a period of time, causes the lens to be tinted yellow. In particular, lenses made of polycarbonate (PC) resin are frequently employed for the front lens of vehicle headlamps and are likely to be discolored upon irradiation with UV light.

In many conventional vehicle headlamps, a portion of the inner surface of the lamp body has a reflecting surface that is coated with an UV absorbing film formed of an UV absorbing material. The UV absorbing film prevents discoloration of the front lens.

In addition, many conventional headlamps include a second film or coating on the inner surface of the front lens. The second film or coating can be an anti-haze film formed of an anti-haze material that prevents the lamp chamber from being subjected to mist, condensation or other forms of haze. Examples of materials that can be used for the anti-haze material along with examples of the specific weight ratios and content descriptions of such materials are disclosed in Japanese Laid Open Patent No. 2-255854, which is incorporated herein by reference.

In the aforementioned conventional vehicle headlamp, the UV absorbing film for preventing discoloration of the front lens and the anti-haze film for preventing lamp chamber haze are separately applied to different portions of the inside of the lamp chamber. Therefore, the respective film coating processes have to be conducted separately and individually, which may complicate the overall lamp production process, increase the processing time, and thus result in an increased manufacturing cost.

SUMMARY OF THE INVENTION

Accordingly, the invention is directed to a vehicle lamp, specifically, a vehicle headlamp that includes a protective film which substantially obviates one or more of the problems due to limitations and disadvantages of the related art.

In view of the foregoing, an object of the invention is to overcome the problems of the conventional art by forming a film for preventing both lamp chamber haze caused by mist or condensation, and discoloration of the front lens caused by UV light emitted from the light source. To solve the aforementioned task, a vehicle lamp is provided in which an anti-haze/UV film is prepared by mixing UV absorbing material with anti-haze material. The anti-haze/UV film is coated to the inner surface of the front lens.

Therefore, the vehicle lamp according to the invention eliminates the necessity of applying the anti-haze film and the UV absorbing film individually to different portions within the lamp chamber to prevent lamp chamber haze and discoloration of the front lens caused by condensation and the UV light emitted from the lamp chamber of the lamp, respectively.

According to an aspect of the invention, a lamp is designed for exposure to adverse or outdoor conditions and includes a lamp body defining a lamp chamber and including a front opening. A front lens can be located in the front opening of the lamp body and include an inner surface further defining the lamp chamber. A light source can be located in the light chamber. A film material can be located adjacent to said inner surface of the front lens and include a mix of TV absorbing material and anti-haze material.

According to another aspect of the invention, a method for making a lamp includes providing a lamp housing that includes an opening therein and defines a lamp cavity, providing a lamp lens with an inner surface that cooperates with the lamp housing to further define the lamp cavity, and coating the inner surface of the lamp lens with a coating that contains UV absorption material and anti-haze material.

According to another aspect of the invention, a lamp is designed for exposure to adverse or outdoor conditions and includes a lamp body defining a lamp chamber and including a front opening. A front lens can be located in the front opening of the lamp body and include an inner surface further defining the lamp chamber. A light source can be located in the light chamber. The lamp includes means attached to said front lens for preventing condensation from forming on, and for preventing ultraviolet light rays from contacting said front lens, wherein said means is an integral, unitary structure.

According to another aspect of the invention, a vehicle headlamp can be a projection-type lamp having a projection unit. The projection unit can be formed by joining a projection lens to a front opening of an elliptic reflector disposed in a lamp chamber. Although a projection-type headlamp has great condensing power and tends to discolor the front lens with its high energy UV light, an anti-haze film containing UV absorbing material located on the front lens can prevent such discoloration of the front lens. When the anti-haze film containing UV absorbing material is provided in a projection-type headlamp, the UV absorbing effectiveness can be significantly improved.

According to another aspect of the invention, the anti-haze material can be prepared by retaining a surface active agent in a block copolymer formed of hydrophilic polymer components and hydrophobic polymer components. A benzotriazole material can be used as the UV absorbing material. Accordingly, lens haze can be prevented, good adhesiveness to the lens can be achieved and the film can include high strength characteristics. Because benzotriazole materials are less expensive than material popularly employed for UV absorbing material, for example, zinc oxide, the manufacturing cost of the vehicle headlamp can be reduced.

According to another aspect of the invention, the weight ratio of the UV absorbing material to the anti-haze material is equal to or less than 10%. At this range of weight ratio values the effectiveness of the anti-haze material is acceptable and is capable of preventing lamp chamber haze.

According to another aspect of the invention, the thickness of the anti-haze film is greater than or equal to 1 μm and less than or equal to 10 μm. As a result, an excessive increase in the film thickness can be prevented. This selected range for the thickness of the anti-haze/UV film results in an effective anti-haze film and avoids the problems due to excessive film thickness, for example, deteriorated surface smoothness, blooming phenomenon resulting in poor lens appearance, and deteriorated adhesiveness of the film to the lens.

Other objects, features and advantages of the invention will be evident from the following detailed description of the preferred embodiments described in conjunction with the attached drawings. It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention.

In the drawings:

FIG. 3 is a table of data showing anti-haze performance as it varies with different weight ratios for the UV absorbing material of the anti-haze film embodying the principles of the invention; and FIG. 4 is a table of data showing anti-haze performance as it varies with different thicknesses for the anti-haze film embodying the principles of the invention.

DETAILED DESCRIPTION OF THE PREFERRED EMBODIMENT

Reference will now be made in detail to the preferred embodiments of the present invention, examples of which are illustrated in the accompanying drawings. Specifically, an illustrated embodiment of the present invention will now be described involving a vehicle headlamp with protective film. The inventive embodiment is described in relation to a projection-type headlamp that has a configuration based on the image projection principles for a projector.

Figure 1:
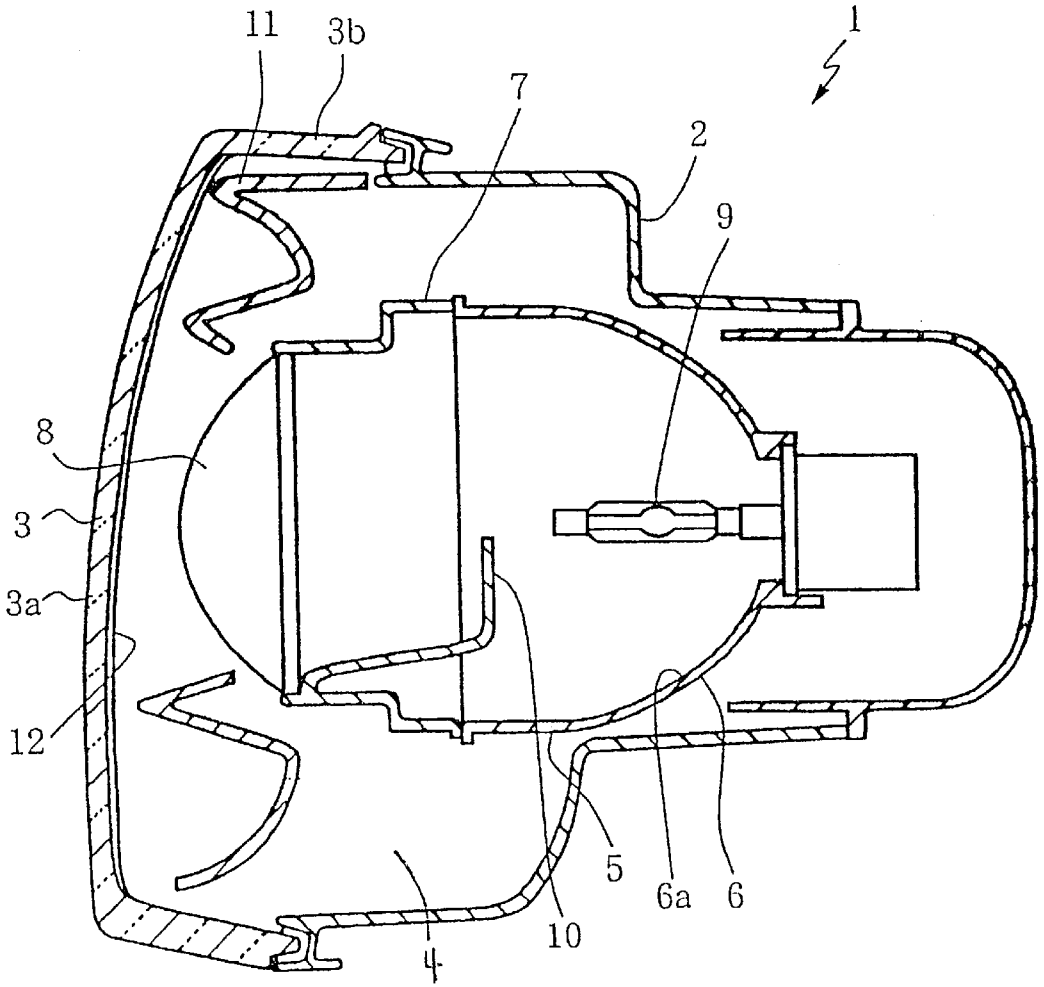
FIG. 1 is a vertical cross sectional view of a vehicle headlamp embodying the principles of the invention.

As seen, for example, in FIG. 1, the vehicle headlamp 1 can include a projection unit 5 that is disposed in a lamp chamber 4 defined by a lamp body 2 and a front lens 3. The lens 3 can be formed of a resin material, for example, polycarbonate (PC) resin and cover a front opening of the lamp body 2. The front lens 3 preferably has a main body 3*a* that faces substantially in a longitudinal direction of the headlamp 1 and a flange portion 3*b* that projects rearward from the outer periphery of the main body 3*a*. The main body 3*a* and flange portion 3*b* can be integrally formed with each other. The rear end of the flange portion 3*b* can be connected to the end of the opening of the lamp body 2.

A projection unit 5 can be located in the lamp chamber 4 and include a projection lens 8 joined to a front portion of an elliptically shaped reflector 6 by a substantially cylindrical fitting 7. The reflector 6 can include a reflective surface 6*a* and a discharge lamp bulb 9 that serves as a light source. A shade 10 can be integrally joined to the fitting 7. An extension 11 for covering the periphery of the projection lens 8 within the lamp chamber 4 can be disposed at a front of the projection lens 8.

The inner surface of the main body 3*a* of the front lens 3 can be coated with an anti-haze film 12. The anti-haze film 12 is prepared by mixing an UV absorbing material with an anti-haze material. The mixture can be sprayed onto the inner surface of the front lens 3 to form the anti-haze/UV film 12.

The anti-haze material is prepared by retaining a surface active agent in a block copolymer formed of hydrophilic polymer components and hydrophobic polymer components.

The block copolymer formed of hydrophilic polymer components and hydrophobic polymer components can be, for example, various block copolymers prepared by known manufacturing processes. Some of the known manufacturing processes are, for example, radical polymerization, cationic ring opening polymerization, anionic living polymerization, cationic living polymerization and the like. The surface active agent can be, for example, a nonionic surface active agent, an anion surface active agent, and a combination of the nonionic surface active agent and the anion surface active agent.

The weight ratio of the hydrophilic polymer components and the hydrophobic polymer components should be set such that the content of the hydrophilic polymer components is set to at least 5% or higher in view of compatibility with the surface active agent, and the content of the hydrophobic polymer components is at least 5% or higher in view of water resistance and adhesiveness with a member to be coated.

The material having a surface active agent retained in the block copolymer formed of the hydrophilic polymer components and hydrophobic polymer components exhibits an excellent capability for preventing haze in a lamp lens. The material also exhibits excellent adhesive qualities with a member to be coated, and high coating strength.

The UV absorbing material can be a benzotriazole material, for example;

2(2'-hydroxy-5-methylphenyl)benzotriazole,

2(2'-hydroxy-3',5'-di-tert-butylphenyl)benzotriazole,

2(2'-hydroxy-3'-tert-butyl-5'-methylphenyl) benzotriazole, and the like.

Zinc oxide has conventionally been used as the UV absorbing material for vehicle headlamps. However, zinc oxide is relatively expensive and therefore considerably increases the cost of manufacturing the lamp product. Accordingly, the manufacturing cost of a vehicle headlamp can be decreased by using a benzotriazole material for the UV absorbing material. Benzotriazole materials are less expensive than zinc oxide.

In addition, the UV absorbing material may be a benzophenone material, a cyanoacrylate material, a salicylate material or the like.

Preferably the weight ratio of the UV absorbing material to the anti-haze material is 10% or less. If the weight ratio of the UV absorbing material exceeds 10%, the effectiveness of the anti-haze material deteriorates, as described later. A deterioration in effectiveness results in an apparent haze in the lens 3 of the vehicle headlamp 1 when the headlamp is exposed to certain operating conditions. Light emitted from the discharge-lamp bulb 9 is reflected by an inner surface 6*a* (reflecting surface) of the reflector 6 so as to be emitted to the outside through the projection lens 8 and the front lens 3. Light emitted from the discharge-lamp bulb 9 is condensed to shine through the portion above the upper edge of the shade 10. Accordingly, the light is cut to form a projected cut line when the lamp operates in its low beam mode.

The anti-haze/UV film 12 coated to the inner surface of the front lens 3 serves to filter out UV light contained in the light emitted from the discharge-lamp bulb 9. Thus, anti-haze/UV film 12 prevents UV from passing through lens 3 and effectively eliminates discoloration of the lens 3. Moreover, the anti-haze material of the anti-haze film 12 prevents haze from occurring in the lamp chamber 4. The anti-haze film 12 thus prevents deterioration in the light distribution characteristics of the lens caused by haze.

The vehicle headlamp 1 described is of the projection-type having a projection unit 5 constructed by joining the projection lens 8 with the front opening of the elliptic reflector 6 that is disposed within the lamp chamber 4. Accordingly, the headlamp 1 exhibits great condensing power. As a result, the front lens 3 is susceptible to discoloration due to the UV light that is projected at the lens 3. However, the anti-haze film 12 prevents discoloration of the front lens 3 caused by the UV light. When the anti-haze film 12 is located adjacent to the projection-type headlamp, the UV absorbing effect can be significantly improved.

Figure 2:
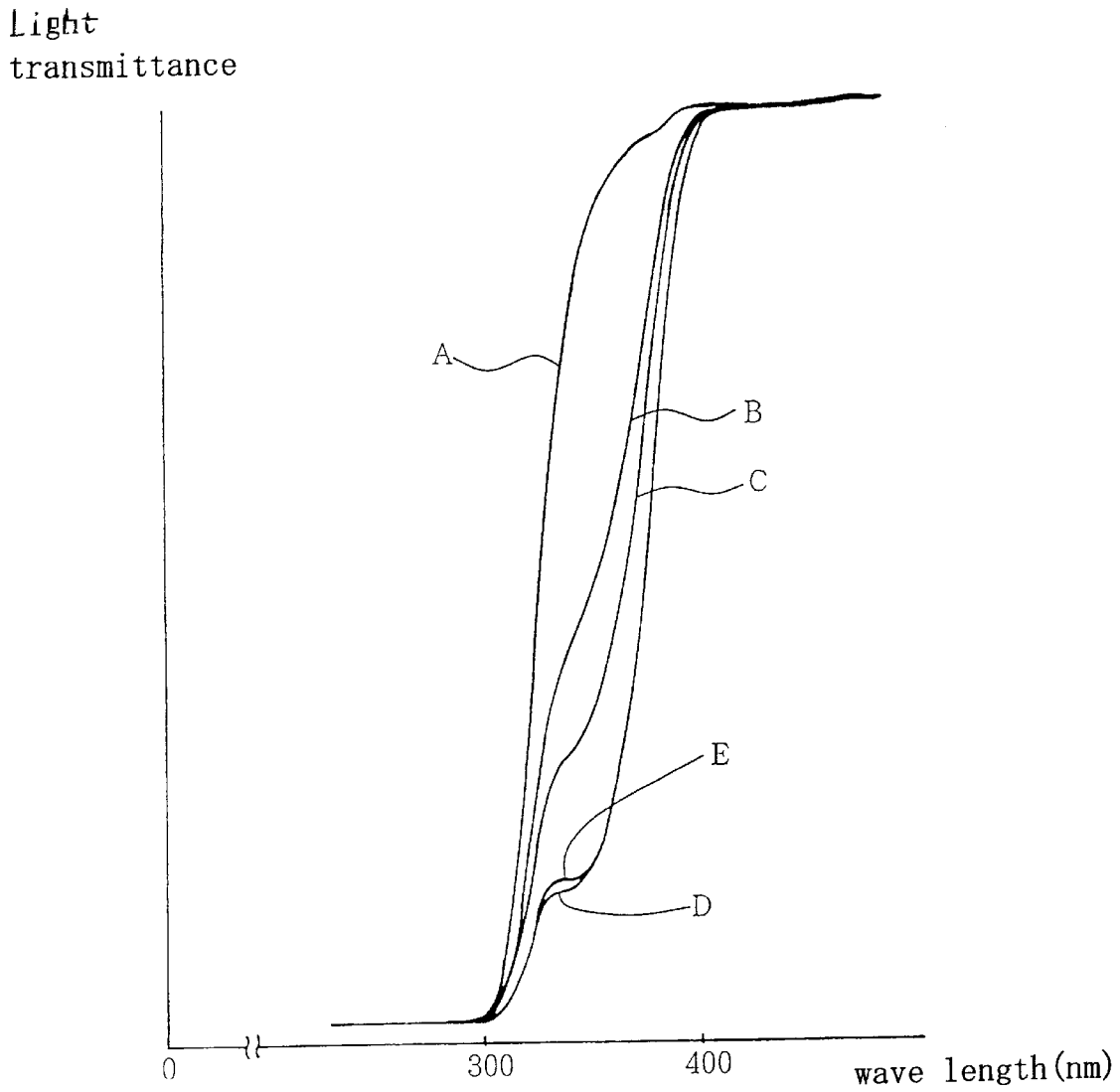
FIG. 2 is a graph showing the effect of UV absorption capability for an anti-haze film containing UV absorbing material and embodying the principles of the invention, UV absorption capability for films of different weight % and thicknesses are shown in the graph as set forth in the accompanying table.

FIG. 2 shows the relationship between light transmittance and wavelength for an anti-haze film 12 at varied weight ratios (wt. % of the UV absorbing material to the anti-haze material). Note that the datum obtained at the condition where the wt. % is zero (item "A" in the table of FIG. 2) represents a film formed only of the anti-haze material containing no UV absorbing material.

The wavelength for UV light ranges from 300 nm to 400 nm. As can be understood from FIG. 2, the anti-haze film 12 can substantially prevent UV light from passing therethrough.

FIG. 3 is a table of data showing the anti-haze performance according to the different weight ratios of UV absorbing material to anti-haze material in the anti-haze film 12. Specifically, FIG. 3 is a table showing the result of three tests conducted on anti-haze films 12 having different weight ratios (the weight ratio of the UV absorbing material to the anti-haze material). The three tests include the exhalation anti-haze test, the steam test (80° C.), and the exhalation anti-haze test after hot water immersion at 40° C. for 240 hours.

The data of the uppermost column of FIG. 3 show the results of the exhalation test in which each lens coated with anti-haze film 12 is subjected to exhalation. The data of the intermediate column show the results of the steam test in which each lens coated with the anti-haze film 12 was exposed to steam. The data of the lower column show the results of the exhalation anti-haze test after hot water immersion in which each lens coated with the anti-haze film 12 is subjected to exhalation after hot water immersion at 40° C. for 240 hours.

As shown in FIG. 3, when the weight ratio exceeds 10%, the lens becomes hazed in the exhalation anti-haze test after hot water immersion. When the weight ratio reaches 15%, the lens becomes hazed in the exhalation anti-haze test and the steam test. Furthermore, the lens becomes noticeably hazed in the exhalation anti-haze test after hot water immersion.

Thus, if the weight ratio of the UV absorbing material of the anti-haze film 12 exceeds 10%, the effectiveness of the anti-haze material deteriorates. Excellent anti-haze capability can be maintained as long as the weight ratio is kept at 10% or less.

FIG. 4 shows data indicating the performance of the anti-haze/UV film 12 in accordance with different thicknesses of the anti-haze/UV film 12. Specifically, FIG. 4 shows three characteristics of the anti-haze film 12 as they vary with different thicknesses for the anti-haze film 12. The three characteristics are; 1) initial appearance immediately after coating of the anti-haze film 12 to the lens, 2) adhesiveness of the anti-haze film 12 to the lens, and 3) persistency (durability) of anti-haze capability.

As shown in FIG. 4, when the thickness of the anti-haze film 12 is 0.5 $\mu$m, the surface smoothness of the film is unacceptable due to a deteriorated, poor appearance. When the thickness of the anti-haze film 12 is 11 $\mu$m, a noticeable blooming phenomenon is observed in which lubricant or the like is ejected from the anti-haze film 12 and appears as a white bloom or in a blurred pattern formed on the lens surface. Furthermore, the adhesiveness of the anti-haze/UV film 12 to the lens is also unsatisfactory at a thickness of 11 $\mu$m.

As described above, if the thickness of the anti-haze/UV film 12 is less than or equal to 0.5 $\mu$m, or, greater than or equal to 11 $\mu$m, the performance of the anti-haze/UV film 12 fails to meet an acceptable quality level. Thus the thickness of the anti-haze/UV film 12 is preferably greater than or equal to 1 $\mu$m and less than or equal to 10 $\mu$m. Excellent performance of the anti-haze/UV film 12 can be observed as long as the film thickness is within the aforementioned range.

As described above, the headlamp for a vehicle according to the invention incorporates a discharge-lamp bulb serving as a light source disposed in a lamp chamber. The lamp chamber can be defined by a lamp body and a front lens made of a resin material. A film prepared by mixing a UV absorbing material with an anti-haze material can be applied to the inner surface of the front lens. Application of this single film can prevent the lamp chamber haze that is caused by mist, condensation or other forms of haze and can also prevent discoloration of the front lens caused by UV light emitted from the lamp light source. The incorporation of UV absorbing material with an anti-haze material into a single coating material eliminates the necessity to coat the lens with an anti-haze film and an Lw absorbing film separately and to different portions within the lamp chamber. Therefore, the coating process is simplified and the time required to complete the coating process is shortened. As a result, the cost required to manufacture the vehicle headlamp can be reduced.

Although the invention has been described in relation to a vehicle headlamp, it is not beyond the scope of the invention to configure the lamp as a tail lamp, side lamp or other general vehicle lamp. Furthermore, the inventive concepts can be used in any type of light that is used in conditions in which bright light is necessary and the environment makes the light liable to either a haze forming in the light chamber or discoloration of a lens surface of the lamp. For example, the inventive lamp can be configured as a flood lamp, search light or other similar lamp.

The preferred material for the lens of the lamp is plastic resin. However, other materials can be used provided they exhibit similar light projecting qualities for the lamp. For example, glass or crystal can be used to form the lens of the lamp. Likewise, the body of the lamp can be made from any material that exhibits the qualities necessary to form the body in accordance with the principles of the invention. For example, the lamp body and related components can be formed of plastic, metal, or various metal alloys.

Although the preferred method for applying the anti-haze/UV film is to spray it onto the lens surface, it should be realized that the anti-haze/UV film can be applied in many other ways including dunking the lens into the material that forms the anti-haze/UV film.

Although the invention has been described in its preferred form to a certain degree of particularity, it is understood that the present disclosure of the preferred form can be varied in the details of construction and in the combination and arrangement of parts without departing from the spirit and the scope of the invention. Thus, it is intended that the invention cover modifications and variations of this invention provided they come within the scope of the appended claims and their equivalents.

What is claimed is:

1. A lamp for exposure to adverse conditions, comprising:

a lamp body defining a lamp chamber and including a front opening;

a front lens made of a resin material, located in said front opening of said lamp body and including an inner surface that further defines said lamp chamber;

a light source located in said lamp chamber; and a film applied over at least a portion of said inner surface of the front lens, said film including a mixture of UV absorbing material and anti-haze material.

2. The lamp for exposure to adverse conditions according to claim 1, wherein said film is prepared by mixing said UV absorbing material with said anti-haze material into a single film material.

3. The lamp for exposure to adverse conditions according to claim 1, wherein said lamp is a projection-type lamp having a projection unit formed by joining a projection lens to a front opening of an elliptic reflector disposed in said lamp chamber.

4. The lamp for exposure to adverse conditions according to claim 1, wherein said anti-haze material includes a surface active agent retained in a block copolymer formed of hydrophilic polymer components and hydrophobic polymer components, and said UV absorbing material includes a benzotriazole material.

5. The lamp for exposure to adverse conditions according to claim 4, wherein said UV absorbing material is mixed with said anti-haze material at a predetermined weight ratio of UV absorbing material to anti-haze material and said predetermined weight ratio is equal to or less than 10%.

6. The lamp for exposure to adverse conditions according to claim 5, wherein said film has a thickness between 1 $\mu$m and 10 $\mu$m.

7. The lamp for exposure to adverse conditions according to claim 4, wherein said film has a thickness between 1 $\mu$m and 10 $\mu$m.

8. The lamp for exposure to adverse conditions according to claim 1, wherein said film has a thickness between 1 $\mu$m and 10 $\mu$m.

9. The lamp for exposure to adverse conditions according to claim 1, wherein said UV absorbing material is mixed with said anti-haze material at a predetermined weight ratio of UV absorbing material to anti-haze material and said predetermined weight ratio is less than or equal to 10%.

10. The lamp for exposure to adverse conditions according to claim 1, wherein said film includes a benzotriazole material and a surface active agent retained in a block copolymer formed of hydrophilic polymer components and hydrophobic polymer components.

11. The lamp for exposure to adverse conditions according to claim 1, wherein said lamp is a headlamp for a vehicle.

12. The lamp for exposure to adverse conditions according to claim 1, wherein said anti-haze material prevents condensation from forming on said front lens and said UV absorbing material prevents ultraviolet light rays from contacting said front lens.

13. A method for making a lamp, comprising:

providing a lamp housing that includes an opening therein and defines a lamp cavity;

providing a lamp lens with an inner surface that cooperates with said lamp housing to further define said lamp cavity; and coating said inner surface of said lamp lens with a coating that contains UV absorption material and anti-haze material.

14. The method for making a lamp of claim 13, wherein said step of coating includes spraying a liquid that includes UV absorption material and anti-haze material onto said lamp lens to form said coating that contains UV absorption material and anti-haze material.

15. The method for making a lamp of claim 14, wherein said step of coating includes creating a film on said inner surface of the lamp lens.

16. The method for making a lamp of claim 13, wherein said step of coating includes spraying a substance that includes a benzotriazole material and a surface active agent retained in a block copolymer formed of hydrophilic polymer components and hydrophobic polymer components onto said lamp lens to form said coating that contains UV absorption material and anti-haze material.

17. The method for making a lamp of claim 16, further comprising:

attaching said lamp lens to said opening in the lamp housing.

18. A lamp for exposure to adverse conditions, comprising:

a lamp body defining a lamp chamber and including a front opening;

a front lens located in said front opening of said lamp body and including an inner surface that further defines said lamp chamber;

a light source located in said lamp chamber; and means attached to said front lens for preventing condensation from forming on and ultraviolet light rays from contacting said front lens, wherein said means is an integral, unitary structure.

19. The lamp for exposure to adverse conditions according to claim 18, wherein said means attached to said front lens includes an anti-haze material mixed with UV absorbing material.

20. The lamp for exposure to adverse conditions according to claim 19, wherein said anti-haze material includes a surface active agent retained in a block copolymer formed of hydrophilic polymer components and hydrophobic polymer components, and said UV absorbing material includes a benzotriazole material.

* * * * *